United States Patent [19]

Chivens et al.

[11] 4,105,341

[45] Aug. 8, 1978

[54] PRINT ELEMENT HAVING FLEXIBLE CHARACTERS

[75] Inventors: Donald R. Chivens, Northridge; Edward C. Kelm, Pasadena, both of Calif.

[73] Assignee: Lexitron Corporation, Chatsworth, Calif.

[21] Appl. No.: 823,440

[22] Filed: Aug. 10, 1977

[51] Int. Cl.[2] ..... B41J 1/32

[52] U.S. Cl. ..... 400/144.2; 101/93.48

[58] Field of Search ..... 101/93.15, 93.16, 93.17, 101/93.19, 93.48, 111; 197/36, 53, 54, 49

[56] References Cited

U.S. PATENT DOCUMENTS

| | | | |
|---|---|---|---|
| 2,912,091 | 11/1959 | Gemmel | 197/49 |
| 3,651,916 | 3/1972 | Becchi | 197/54 |
| 3,707,214 | 12/1972 | Ponzano | 197/53 |
| 3,884,340 | 5/1975 | Tramposch et al. | 197/53 |
| 3,907,091 | 9/1975 | Meier et al. | 197/53 |
| 3,935,937 | 2/1976 | Tramposch | 197/53 |
| 3,954,163 | 5/1976 | Gabor | 197/53 |

FOREIGN PATENT DOCUMENTS

| | | | |
|---|---|---|---|
| 1,575,348 | 7/1969 | France | 197/53 |
| 1,168,756 | 10/1969 | United Kingdom | 197/49 |

*Primary Examiner*—Paul T. Sewell
*Attorney, Agent, or Firm*—Martin R. Horn

[57] ABSTRACT

A print element for use in high speed printing machines, having a plurality of metallic print characters which are substantially flat and are flexible. The characters are struck by a hammer surface which is curved so as to conform to the curvature of the platen upon which the characters strike. The characters are struck by the curved hammer surface and thereby temporarily deformed to conform to the curvature of the platen, thus producing a character of uniform density on the printing surface.

9 Claims, 5 Drawing Figures

PRINT ELEMENT HAVING FLEXIBLE CHARACTERS

BACKGROUND OF THE INVENTION

1. Field of the Invention

This invention relates to printing devices and in particular to printing devices having a print element the characters of which are selectively engaged by a hammer mechanism for high speed printing of characters on paper.

2. Description of the Prior Art

In current state-of-the-art serial impact printing, 30 to 55 characters per second is considered high speed. In many of such high speed printing devices a rotatable curved platen is used. As a result it has been generally concluded that in order to print on a paper placed against the curved platen, and obtain characters of uniform clarity and density, the type character must have a curved surface conforming to the curved surface of the platen.

It is common for a high speed printing device to employ a print wheel. These wheels are typically thin discs of plastic or metal, having slots cut radially around the circumference so as to provide a plurality of flexible spokes. The print characters are located on one side of the disc and towards the radially outer end of the spokes.

When made of plastic, the print wheel is generally injection molded. The mold is such as to provide the surface of the type characters with a curvature corresponding to the curvature of the platen. Printing is accomplished by striking the rear of the spoke, upon which the type character is located, with a hammer. Repeated hammering causes such plastic characters to deteriorate rapidly in print quality due to wear and deformation of the plastic print character.

It is therefore an object of the present invention to effect a durable print wheel which is both simple and economical to produce, and suitable for use in high speed printers which employ a platen which may not be flat.

Metal is the desirable material to use in making print wheels because of its durability. If a print wheel were to be made of metal, it was believed that the characters would have to be curved to conform to the surface of the platen. It is difficult to produce metal type characters (for high speed printing devices) having curved surfaces. An approach which has not proved successful was to etch flat surfaced print characters and then grind the curvature into the characters. A number of organizations have attempted to utilize techniques of this nature, but the expense and difficulty are so great that the efforts have terminated in failure.

SUMMARY OF THE INVENTION

The print element of the present invention comprises a flat thin metallic disc such as titanium alloy or stainless steel having slots cut radially into the circumference of the disc so as to provide a plurality of flexible spokes on the disc. The print element may be of unitary construction, the type character being produced (for example) by etching the surface at the outer end of the spoke, or the print element may be fabricated by the attaching of preformed type characters to the outer ends of the spokes. Metal deposition techniques may also be used to form the type characters. Either method produces a type character having a flat face. This flat surfaced type character is used in combination with a hammer which has a curved surface which strikes the back side of the type character. The curvature of the hammer corresponds to the curvature of the platen. As the flat surfaced type character is struck by the curved surface of the platen, the cooperation of the platen and hammer causes the flat surfaced type character to be temporarily deformed and assume the curvature of the platen. The force applied by the curved hammer surfaces causes the normally flat type character to deform while in the process of printing so as to produce a printed character that is of uniform clarity and density over the entire length and width of the character. After the character is printed, the hammer is moved away from the spoke of the print wheel and the type character thereon is restored to its normally flat shape.

Because the print wheel and type character are of metal construction, they are durable. Because the type characters are flat they are simple and economical to produce. Because the metal print wheel is thin, its inertia is low enough for high speed printing operation. The print wheel of the present invention is therefore more durable than the plastic wheels and yet is just as fast as the plastic wheels in printing rate.

The novel idea which led to the perfection of the present invention was that a flat surfaced print character could produce a quality character on a curved platen surface if it is struck with a curved hammer surface and thereby temporarily deformed so as to take on a curvature corresponding to the curvature of the printing surface (platen). All prior art printers use permanently curved type characters to print on curved platens. The novelty of the present invention resides in temporarily deforming the flat printing surface, during the printing process.

BRIEF DESCRIPTION OF THE PREFERRED EMBODIMENT

Figure 1:
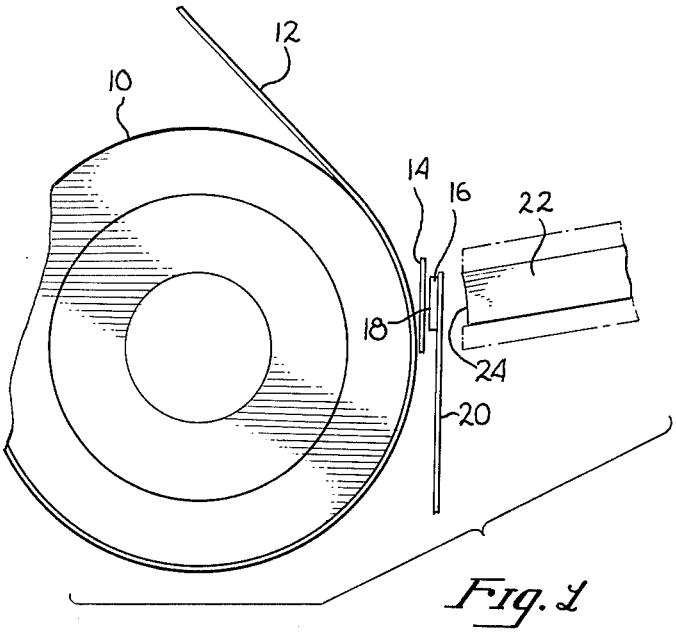
FIG. 1 is a schematic cross-sectional view showing the functional relationship of the various parts of the invention and their interface with that which is old in the printing art (the platen).

The apparatus of the present invention is intended for use primarily in high speed printing devices. Only a very small part of the typical high speed printing device has any relevance to the present invention, and that small part, the platen, is illustrated in FIG. 1. FIG. 1 shows the functional relationship of those parts which produce the actual printed character. Printing devices typically employ a platen 10 which may take on various forms but always serves as a firm backing to support the surface upon which the printing is done, such as a sheet of paper 12. The platen may be curved as shown in FIG. 1 and is generally made of a hard rubber-like substance. Printing on the paper 12 is accomplished by transferring ink from a ribbon 14 onto the surface of the paper 12. This transfer is generally accomplished by striking one side of an ink saturated ribbon 14 with a type character 16. This causes the other side of the ribbon 14 to contact the sheet of paper 12, which is backed by the platen 10. The pressure applied to the ribbon 14 by the cooperation of the platen 10 and type character 16 causes ink from the ribbon 14 to be deposited upon the paper 12 in the shape of the type character 16 which struck the ribbon 14.

The type character 16 must apply pressure to the ribbon 14 in order to cause a character to be printed onto the paper 12. If the platen 10 is curved and the type character 16 is flat, the flat type character will only be able to apply pressure to the ribbon 14 at the point where the type character becomes tangent to the platen 10. This will result in characters which are partially dark and partially light or even invisible.

By means of the present invention a flat type character 16 can be made to produce a uniformly dark character even though the paper is backed by a curved platen.

The device of the present invention comprises a specially constructed type character 16 and a hammer 22 for imparting motion and curvature to the type character 16.

Figure 2:
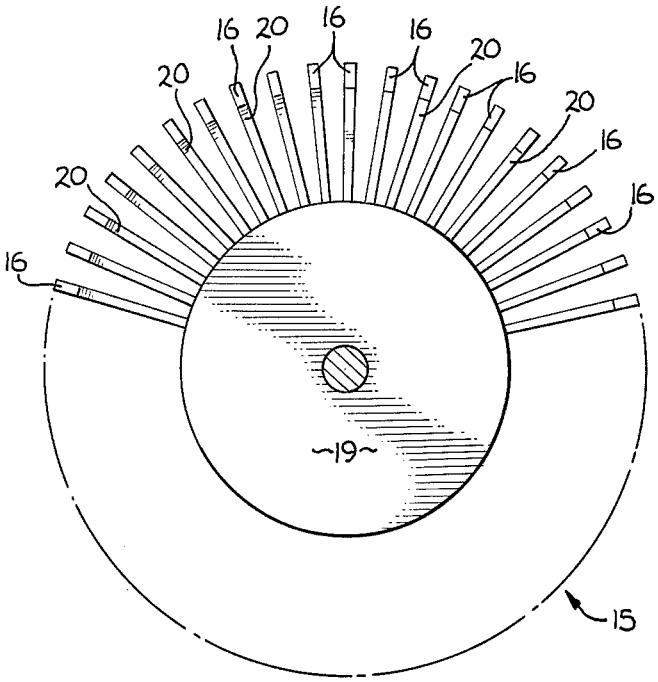
FIG. 2 is a frontal view of a typical print wheel.

FIG. 2 contains a frontal view of the print wheel 15. The print wheel comprises a solid central disc 19 and a plurality of spokes 20 located on the cirumference of the central disc 19. The type characters 16 are formed on one side of the spokes 20.

Figure 3:
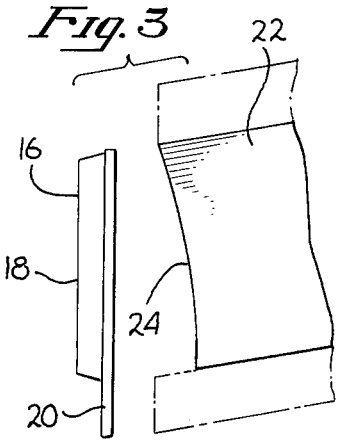
FIG. 3 is an enlarged detail view showing the type character in its normally flat state and the hammer impact surface in its permanently curved state.

A detail view of the key elements of the present invention is given in FIG. 3. This FIGURE shows the outer end of a spoke 20, the flat printing surface 18 of the type character 16 and the curved impact surface 24 of the hammer 22.

The hammer 22 can be made of any suitable material but perferably of metal. The preferred embodiment of the hammer is shown in FIG. 3, an alternate embodiment in FIG. 4. Both hammers are structured such that as the printing surface 18 of the type character first comes into contact with the ribbon 14, paper 12 and platen 10, the hammer 22 contacts the back side of a spoke 20, at two points near the top and near the bottom of the type character 16. At the instant that the hammer 22 contacts the back of a type character, the greater portion of the character is spaced away from the impact surface 24 of the hammer. This space is provided to allow temporary deformation of the type character 16 as it strikes the ribbon and paper which are backed by the curved platen. The curved surface of the platen and the curved impact surface 24 of the hammer 22 cooperate to deform the type characters to their mutual curvature.

Figure 4:
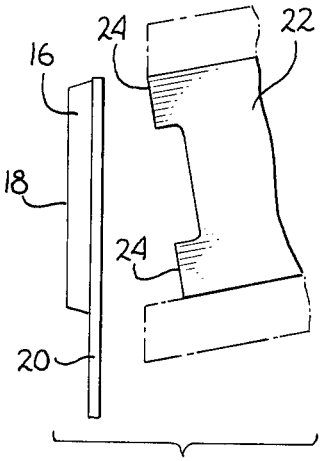
FIG. 4 shows an alternate embodiment of the hammer impact surface.

An alternate configuration for the impact surface 24 of the hamer is illustrated in FIG. 4. This configuration also applies a force at each end of the type character 16, forcing the type character to assume the curvature of the platen. The force in this embodiment is applied by the two flat shoulders at the top and bottom of the hammer impact surface 24. This embodiment is similar to that shown in FIG. 3 in that in both cases, the central portion of the hammer impact surface 24 is recessed from the top and bottom portions. This is to allow the spoke 20 and type character 16 room to deform so as to assume the curvature of the platen 10.

Figure 5:
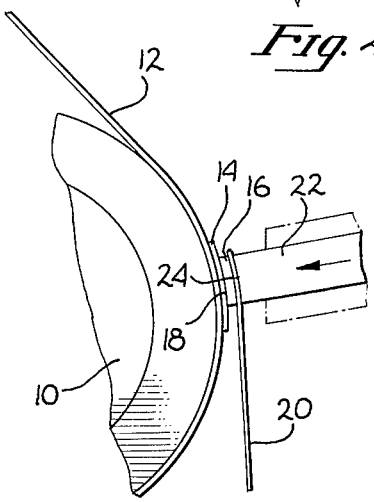
FIG. 5 is a detail view showing the cooperation of the curved platen and curved hammer impact surface to temporarily deform the type character so as to take on the curvature of the platen during the time the type character contacts the printing surface.

FIG. 5 shows the preferred embodiment of the present invention shortly after the moment of impact upon the curved surface of the platen. In this figure the motion of the hammer 22 has forced the spoke 20 and the type character 16 thereon into contact with the platen 10. The curved impact surface 24 of the hammer 22 and the curved surface of the platen 10 have cooperated to cause the type character 16 to assume a similar curvature. Since the type character 16 has assumed a curved printing surface 18, it produces a printed character upon the paper 12 which is of uniform density and clarity over its length and width. As the hammer 22 is brought away from the platen 10, the type character 16 reverts to its flat shape.

While the invention has been particularly shown and described with reference to a preferred embodiment thereof, it will be understood by those skilled in the art that various changes in form and details therein may be made without departing from the spirit and scope of the invention.

What is claimed is:

1. An improvement in high speed printing devices comprising a type character and a hammer cooperative with a platen having a curved surface;

said type character having a normally flat printing surface and being sufficiently thin to permit resilient deformation;

said hammer having an impact surface configured such that as the printing surface of the type charac ter comes into contact with the platen the impact surface of the hammer contacts the back side of said type character at two points, near the top and near the bottom, of the type character;

said hammer being operative to propel said flat type character against the curved surface of the platen; and said curved platen and said hammer being cooperative to deform said flat type character only during printing so as to provide it with a curved printing surface which conforms to the curvature of the platen.

2. The improvement according to claim 1 wherein the type character is formed of metal.

3. The improvement according to claim 2 wherein the metal is a titanium alloy.

4. The improvement according to claim 2 wherein the metal is stainless steel.

5. A hammer and print wheel for use in high speed printing devices having a curved platen;

said print wheel being a metal disc provided with a plurality of radial slots on its circumference so as to form a plurality of spokes of unitary construction with said disc;

said spokes bearing a type character having a normally flat printing surface and being sufficiently thin to permit resilient deformation;

said hammer having an impact surface such that as the printing surface of the type character comes into contact with the platen the impact surface of the hammer contacts the back side of said spoke at substantially two points, near the top and near the bottom of the type character;

said hammer being operative to propel said spoke and flat type character against the curved surface of the platen; and said curved platen and said hammer being cooperative to deform said flat type character and spoke during printing so as to provide the type character with a curved printing surface which conforms to the curvature of the platen.

6. The hammer and print wheel of claim 5 wherein the print wheel and type character are constructed of a titanium alloy.

7. The hammer and print wheel of claim 5 wherein the print wheel and type character are constructed of stainless steel.

8. The hammer and print wheel of claim 5 wherein the type characters are formed by etching.

9. The hammer and print wheel of claim 5 wherein the type characters are formed by depositing a metal upon the spokes.

* * * * *